US008480196B2

(12) United States Patent
Letendre, Jr. et al.

(10) Patent No.: US 8,480,196 B2
(45) Date of Patent: Jul. 9, 2013

(54) METHOD AND APPARATUS TO EJECT DROPS HAVING STRAIGHT TRAJECTORIES

(75) Inventors: William R. Letendre, Jr., Etna, NH (US); Xi Wang, West Lebanon, NH (US); Robert Hasenbein, Enfield, NH (US); Marlene McDonald, Norwich, VT (US); Jaan Laaspere, Norwich, VT (US)

(73) Assignee: FujiFilm Dimatix, Inc., Lebanon, NH (US)

( * ) Notice: Subject to any disclaimer, the term of this patent is extended or adjusted under 35 U.S.C. 154(b) by 430 days.

(21) Appl. No.: 12/605,196

(22) Filed: Oct. 23, 2009

(65) Prior Publication Data

US 2011/0096114 A1 Apr. 28, 2011

(51) Int. Cl.
*B41J 29/38* (2006.01)
*B41J 2/045* (2006.01)

(52) U.S. Cl.
USPC ..... 347/11; 347/68

(58) Field of Classification Search
USPC ..... 347/10–11, 68
See application file for complete search history.

(56) References Cited

U.S. PATENT DOCUMENTS

| | | | | |
|---|---|---|---|---|
| 6,257,686 | B1 * | 7/2001 | Takahashi et al. | 347/10 |
| 6,755,511 | B1 * | 6/2004 | Moynihan et al. | 347/68 |
| 7,281,778 | B2 | 10/2007 | Hasenbein et al. | |
| 2004/0207671 | A1 * | 10/2004 | Kusunoki et al. | 347/10 |
| 2005/0200640 | A1 * | 9/2005 | Hasenbein et al. | 347/11 |
| 2006/0164450 | A1 | 7/2006 | Hoisington et al. | |
| 2006/0181557 | A1 | 8/2006 | Hoisington et al. | |
| 2008/0074451 | A1 | 3/2008 | Hasenbein et al. | |
| 2008/0170088 | A1 | 7/2008 | Letendre et al. | |

FOREIGN PATENT DOCUMENTS

JP 09-057960 3/1997

OTHER PUBLICATIONS

PCT International Search Report for corresponding PCT Patent Application No. PCT/US2010/042401, Feb. 23, 2011, 6 pgs.
PCT Written Opinion of the International Searching Authority for corresponding PCT Patent Application No. PCT/US2010/042401, Feb. 23, 2011, 4 pgs.
"Meniscus", Wikipedia, http://en.wikipedia.org/wiki/Meniscus, Jul. 21, 2009, 2 pages.
Wang, Xi, "Piezoelectric Inkjet Technology—from Graphic Printing to Material Deposition", Nanotech Conference & Expo 2009, Houston, TX, May 3-7, 2009, http://www.nsti.org/Nanotech2009/symposia/pdfs/PiezoelectricInkjetTechnology.pdf, 26 pages.
"PCT International Preliminary Report on Patentability", for corresponding PCT Application No. PCT/US2010/042401, Apr. 24, 2012, 5 pages.

* cited by examiner

*Primary Examiner* — Stephen Meier
*Assistant Examiner* — Sarah Al Hashimi
(74) *Attorney, Agent, or Firm* — Blakely, Sokoloff, Taylor & Zafman LLP

(57) ABSTRACT

Described herein is a method and apparatus for driving a drop ejection device to produce drops having straight trajectories. In one embodiment, a method for driving a drop ejection device having an actuator includes building a drop of a fluid with at least one drive pulse by applying a multi-pulse waveform having the at least one drive pulse and a straightening pulse to the actuator. Next, the method includes causing the drop ejection device to eject the drop with a straight trajectory in response to the pulses of the multi-pulse waveform. The straightening pulse is designed to ensure that the drop is ejected without a drop trajectory error.

20 Claims, 17 Drawing Sheets

VOLTAGE
TIME (μs)
7.168
1610
1650
1750
7.296
3.584
1720
1710
5μs STEPS
5μs
130μs

METHOD AND APPARATUS TO EJECT DROPS HAVING STRAIGHT TRAJECTORIES

TECHNICAL FIELD

Embodiments of the present invention relate to drop ejection, and more specifically to ejecting drops having straight trajectories.

BACKGROUND

Drop ejection devices are used for a variety of purposes, most commonly for printing images on various media. They are often referred to as ink jets or ink jet printers. Drop-on-demand drop ejection devices are used in many applications because of their flexibility and economy. Drop-on-demand devices eject one or more drops in response to a specific signal, usually an electrical waveform, or waveform, that may include a single pulse or multiple pulses. Different portions of a multi-pulse waveform can be selectively activated to produce the drops. One or more drive pulses build a drop from a nozzle of the drop ejection device.

Drop ejection devices typically include a fluid path from a fluid supply to a nozzle path. The nozzle path terminates in a nozzle opening from which drops are ejected. Drop ejection is controlled by pressurizing fluid in the fluid path with an actuator, which may be, for example, a piezoelectric deflector, a thermal bubble jet generator, or an electrostatically deflected element. A typical printhead has an array of fluid paths with corresponding nozzle openings and associated actuators, and drop ejection from each nozzle opening can be independently controlled. In a drop-on-demand printhead, each actuator is fired to selectively eject a drop at a specific target pixel location as the printhead and a substrate are moved relative to one another.

Drop ejection devices need to generate drops sustainably, obtain a required drop volume, deliver material accurately, and achieve a desired delivery rate. Drop placement errors with respect to a target degrade image quality on the target. FIG. 1 illustrates different types of drop placement errors. A drop 120 is fired through a nozzle plate 110 towards a target 130. Vertical line 170 represents an ideal straight drop trajectory. However, a nozzle error 180 results from a misalignment of the nozzle with respect to the target. Vertical line 180 represents a straight drop trajectory from the nozzle to the target with this line being orthogonal to the nozzle plate 110. An angle theta formed between the vertical line 180 and the actual trajectory 190 of the drop represents the jet trajectory error 150. A total drop placement error equals the combination of nozzle placement error and jet trajectory error.

A "permanent" jet straightness occurs when a jet is always straight or always crooked. Jets that are permanently crooked are generally a result of nozzle damage and/or contamination in or around the nozzle. Transient jet straightness occurs when a jet that is straight immediately after priming goes crooked after a period of jetting. These jets may or may not self-recover after a further period of jetting. A jet trajectory error arises from crooked jets. FIGS. 2 and 3 illustrate examples of crooked jets. Area 202 illustrates jets that are crooked in the same direction. Area 204 illustrates twinning in which adjacent jets are crooked in opposite directions. FIG. 3 illustrates the printed areas that result from crooked jets. Arrow 210 points to an area in which crooked jets cause the line-to-line distance to become uneven. Arrow 220 points to an area in which transient jet straightness causes the position of printed lines to change over a period of time. Arrow 230 points to an area in which twinning causes two neighboring lines to merge into one line. In either case, the image quality produced from the crooked jets is degraded.

SUMMARY

Described herein is a method and apparatus for driving a drop ejection device to produce drops having straight drop trajectories. In one embodiment, a method for driving a drop ejection device having an actuator includes building a drop of a fluid with at least one drive pulse by applying a multi-pulse waveform having the at least one drive pulse and a straightening pulse to the actuator. Next, the method includes causing the drop ejection device to eject the drop with a straight trajectory in response to the pulses of the multi-pulse waveform. The straightening pulse is designed to ensure that the drop is ejected without a drop trajectory error.

BRIEF DESCRIPTION OF THE DRAWINGS

The present invention is illustrated by way of example, and not by way of limitation, in the figures of the accompanying drawings and in which.

DETAILED DESCRIPTION

Described herein is a method and apparatus for driving a drop ejection device to produce drops ejected with straight trajectories. In one embodiment, a method for driving a drop ejection device having an actuator includes building a drop of a fluid with at least one drive pulse by applying a multi-pulse waveform having the at least one drive pulse and a straightening pulse to the actuator. Next, the method includes causing the drop ejection device to eject the drop with a straight trajectory in response to the pulses of the multi-pulse waveform. The straightening pulse is designed to ensure that the drop is ejected without a drop trajectory error.

The straightening pulse causes the straightening of the drop formed by the at least one drive pulse by bulging a meniscus position of fluid past the nozzle in order to reduce a potential drop trajectory error. The straightening pulse also reduces asymmetric wetting issues by changing meniscus characteristics. In some embodiments, the drop ejection device ejects additional boluses of the fluid in response to the pulses of the multi-pulse waveform or in response to pulses of additional multi-pulse waveforms.

Figure 1:
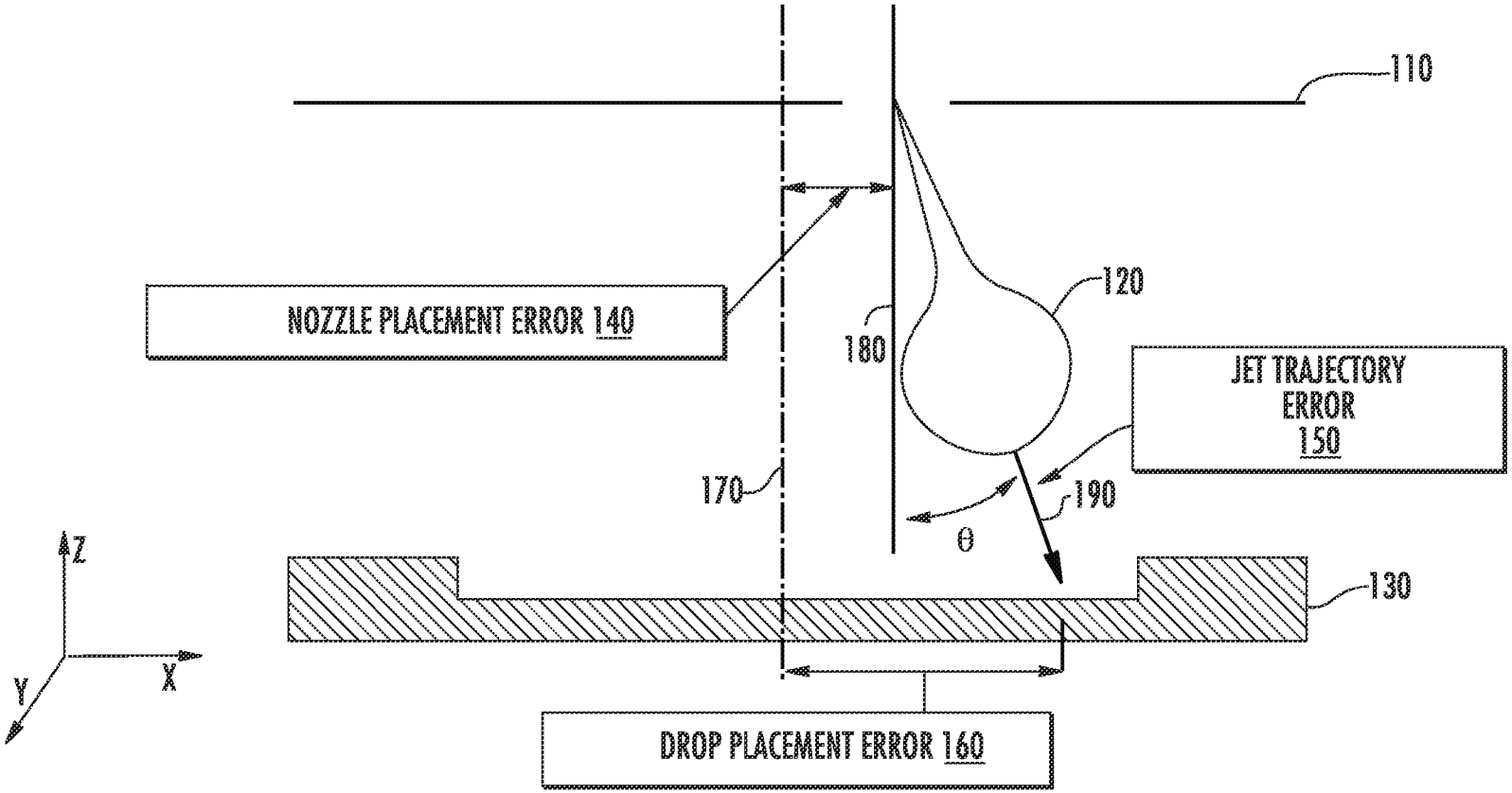
FIG. 1 (PRIOR ART)
FIG. 1 is a cross-sectional side view of a nozzle plate of an ink jet printhead in relation to a target in accordance with a conventional approach.
Figure 2:
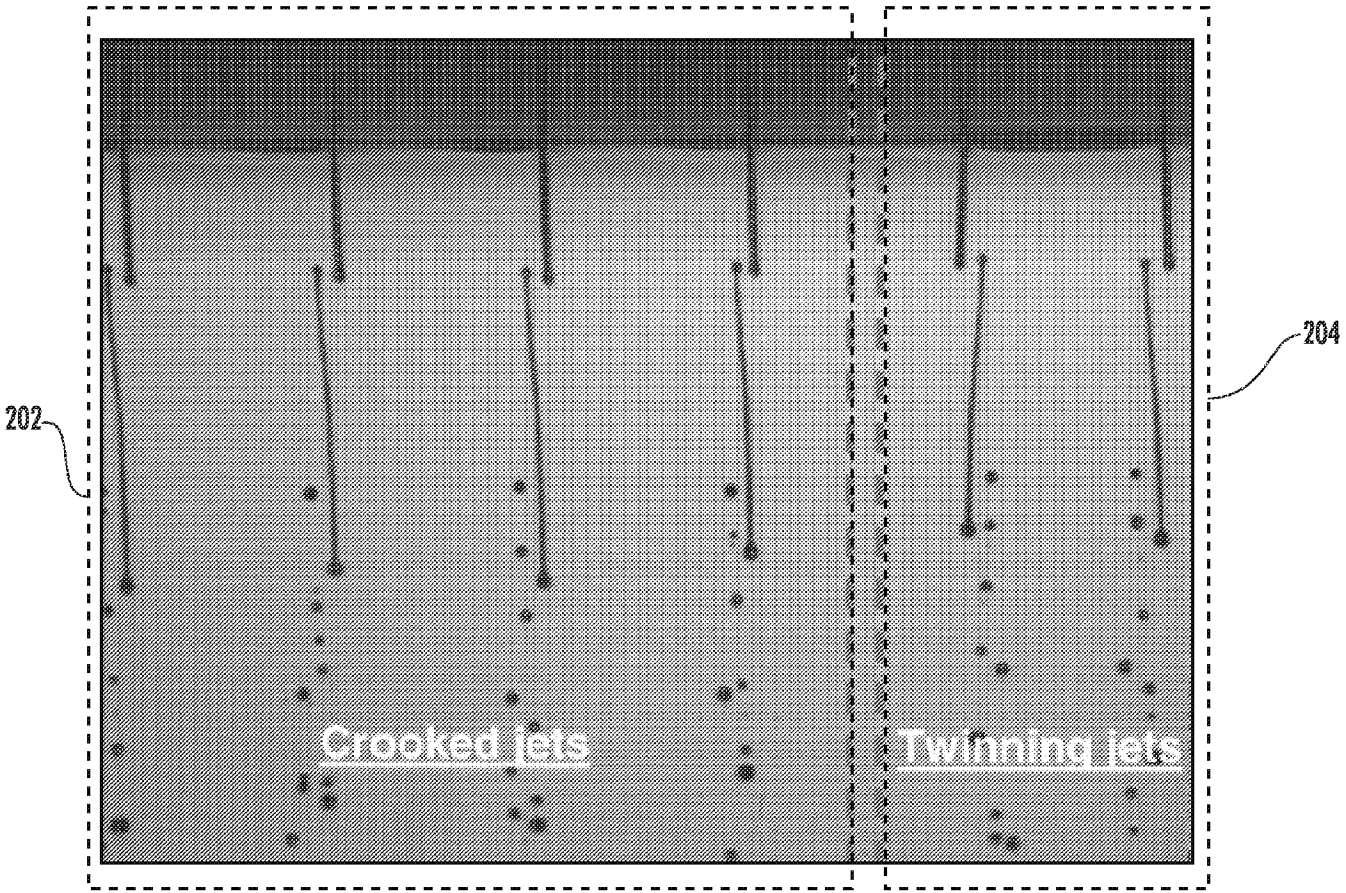
FIG. 2 (PRIOR ART)
FIG. 2 illustrates drops being ejected from crooked jets in accordance with a conventional approach.
Figure 3:
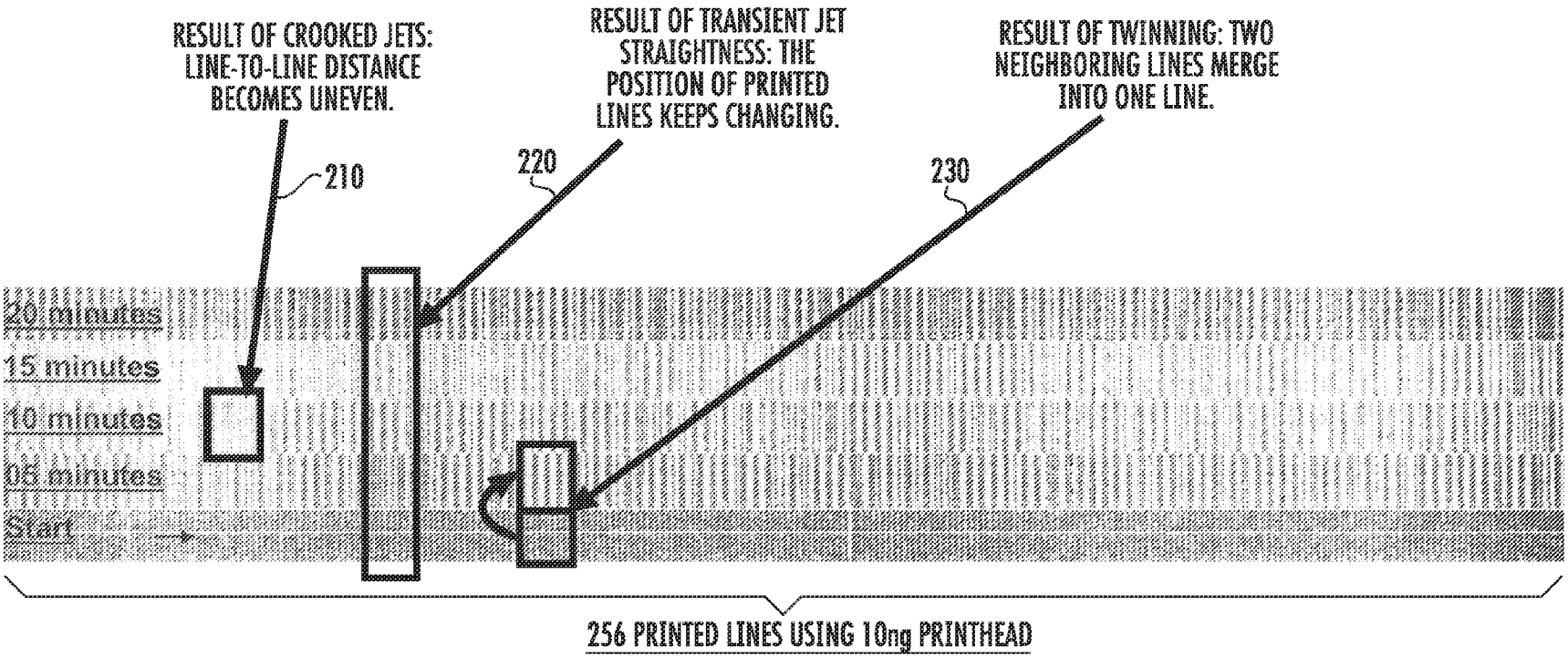
FIG. 3 (PRIOR ART)
FIG. 3 illustrates a degraded printed image resulting from crooked jets, transient jet straightness, and twinning in accordance with a conventional approach.
Figure 4:
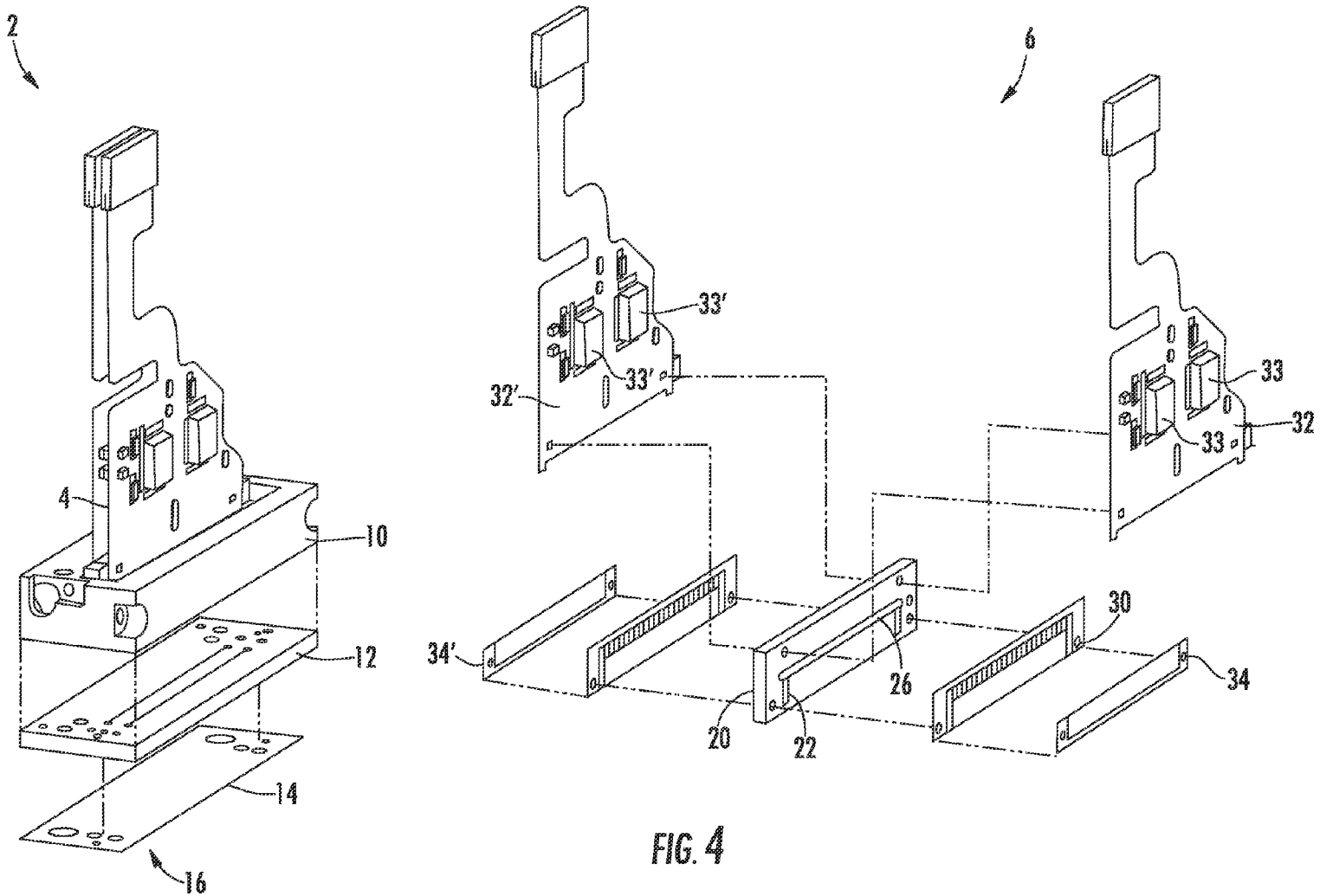
FIG. 4 is an exploded view of a shear mode piezoelectric ink jet print head in accordance with one embodiment.

FIG. 4 is an exploded view of a shear mode piezoelectric ink jet print head in accordance with one embodiment. Referring to FIG. 4, a piezoelectric ink jet head 2 includes multiple modules 4 and 6 which are assembled into a collar element 10 to which is attached a manifold plate 12, and an orifice plate 14. The piezoelectric ink jet head 2 is one example of various types of print heads. Ink is introduced through the collar 10 to the jet modules which are actuated with multi-pulse waveforms to jet ink drops of various drop sizes from the orifices 16 on the orifice plate 14 in accordance with one embodiment. Each of the ink jet modules 4 and 6 includes a body 20, which is formed of a thin rectangular block of a material such as sintered carbon or ceramic. Into both sides of the body are machined a series of wells 22 which form ink pumping chambers. The ink is introduced through an ink fill passage 26 which is also machined into the body.

The opposing surfaces of the body are covered with flexible polymer films 30 and 30' that include a series of electrical contacts arranged to be positioned over the pumping chambers in the body. The electrical contacts are connected to leads, which, in turn, can be connected to flex prints 32 and 32' including driver integrated circuits 33 and 33'. The films 30 and 30' may be flex prints. Each flex print film is sealed to the body 20 by a thin layer of epoxy. The epoxy layer is thin enough to fill in the surface roughness of the jet body so as to provide a mechanical bond, but also thin enough so that only a small amount of epoxy is squeezed from the bond lines into the pumping chambers.

Each of the piezoelectric elements 34 and 34', which may be a single monolithic piezoelectric transducer (PZT) member, is positioned over the flex prints 30 and 30'. Each of the piezoelectric elements 34 and 34' have electrodes that are formed by chemically etching away conductive metal that has been vacuum vapor deposited onto the surface of the piezoelectric element. The electrodes on the piezoelectric element are at locations corresponding to the pumping chambers. The electrodes on the piezoelectric element electrically engage the corresponding contacts on the flex prints 30 and 30'. As a result, electrical contact is made to each of the piezoelectric elements on the side of the element in which actuation is effected. The piezoelectric elements are fixed to the flex prints by thin layers of epoxy.

Figure 5:
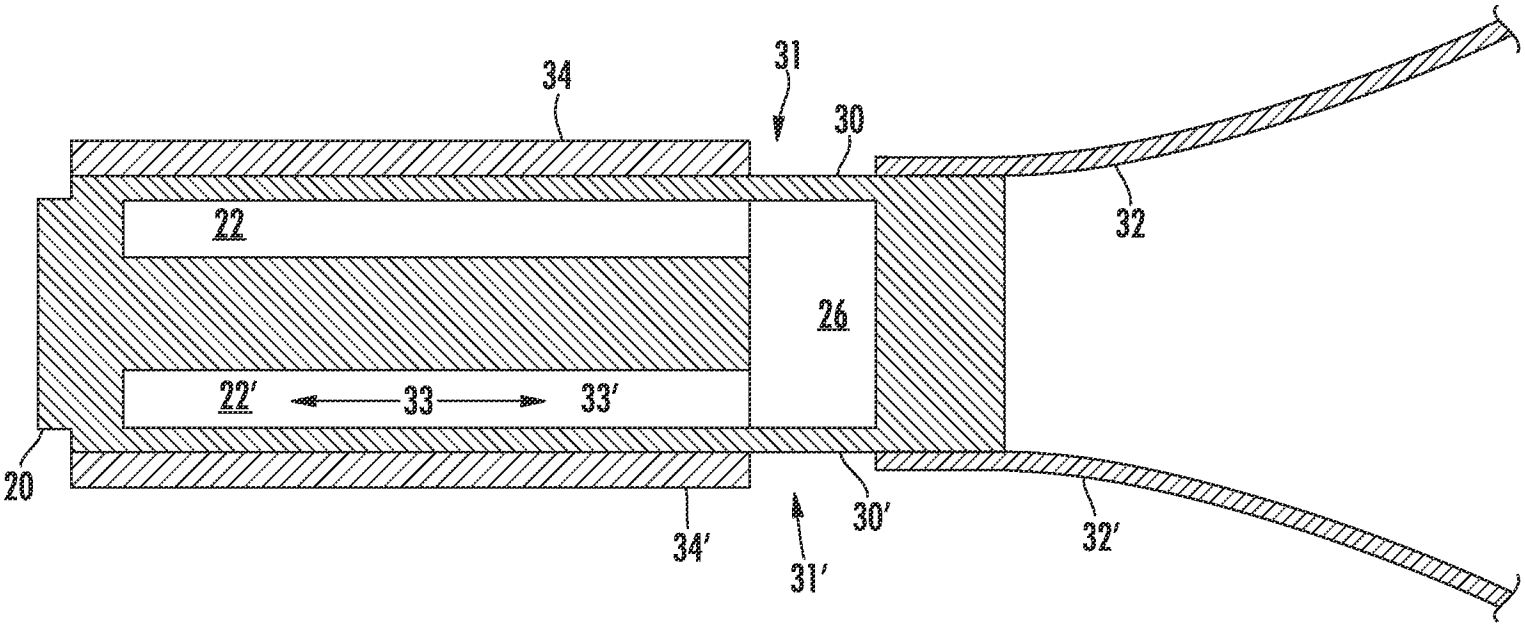
FIG. 5 is a cross-sectional side view through an ink jet module in accordance with one embodiment.

FIG. 5 is a cross-sectional side view through an ink jet module in accordance with one embodiment. Referring to FIG. 5, the piezoelectric elements 34 and 34' are sized to cover only the portion of the body that includes the machined ink pumping chambers 22. The portion of the body that includes the ink fill passage 26 is not covered by the piezoelectric element.

The ink fill passage 26 is sealed by a portion 31 and 31' of the flex print, which is attached to the exterior portion of the module body. The flex print forms a non-rigid cover over (and seals) the ink fill passage and approximates a free surface of the fluid exposed to atmosphere.

In normal operation, the piezoelectric element is actuated first in a manner that increases the volume of the pumping chamber, and then, after a period of time, the piezoelectric element is deactuated so that it returns to its original position. Increasing the volume of the pumping chamber causes a negative pressure wave to be launched. This negative pressure starts in the pumping chamber and travels toward both ends of the pumping chamber (towards the orifice and towards the ink fill passage as suggested by arrows 33 and 33'). When the negative wave reaches the end of the pumping chamber and encounters the large area of the ink fill passage (which communicates with an approximated free surface), the negative wave is reflected back into the pumping chamber as a positive wave, traveling towards the orifice. The returning of the piezoelectric element to its original position also creates a positive wave. The timing of the deactuation of the piezoelectric element is such that its positive wave and the reflected positive wave are additive when they reach the orifice.

Figure 6:
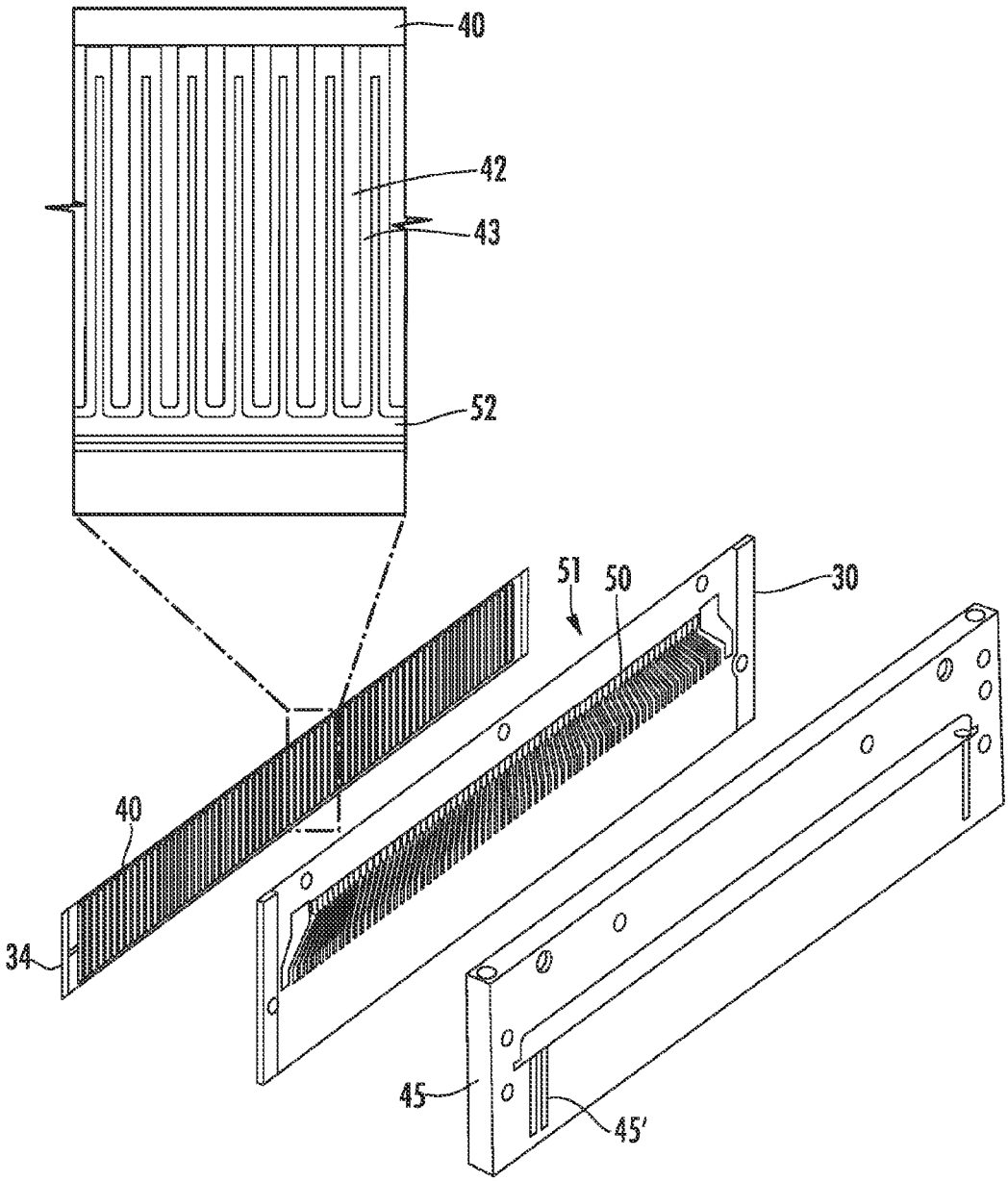
FIG. 6 is a perspective view of an ink jet module illustrating the location of electrodes relative to the pumping chamber and piezoelectric element in accordance with one embodiment.

FIG. 6 is a perspective view of an ink jet module illustrating the location of electrodes relative to the pumping chamber and piezoelectric element in accordance with one embodiment. Referring to FIG. 6, the electrode pattern 50 on the flex print 30 relative to the pumping chamber and piezoelectric element is illustrated. The piezoelectric element has electrodes 40 on the side of the piezoelectric element 34 that comes into contact with the flex print. Each electrode 40 is placed and sized to correspond to a pumping chamber 45 in the jet body. Each electrode 40 has an elongated region 42, having a length and width generally corresponding to that of the pumping chamber, but shorter and narrower such that a gap 43 exists between the perimeter of electrode 40 and the sides and end of the pumping chamber. These electrode regions 42, which are centered on the pumping chambers, are the drive electrodes. A comb-shaped second electrode 52 on the piezoelectric element generally corresponds to the area outside the pumping chamber. This electrode 52 is the common (ground) electrode.

The flex print has electrodes 50 on the side 51 of the flex print that comes into contact with the piezoelectric element. The flex print electrodes and the piezoelectric element electrodes overlap sufficiently for good electrical contact and easy alignment of the flex print and the piezoelectric element. The flex print electrodes extend beyond the piezoelectric element (in the vertical direction in FIG. 6) to allow for a connection (e.g., soldering or non-conductive paste) to the flex print 32 that contains the driving circuitry. It is not necessary to have two flex prints 30 and 32. A single flex print can be used.

Figure 7B:
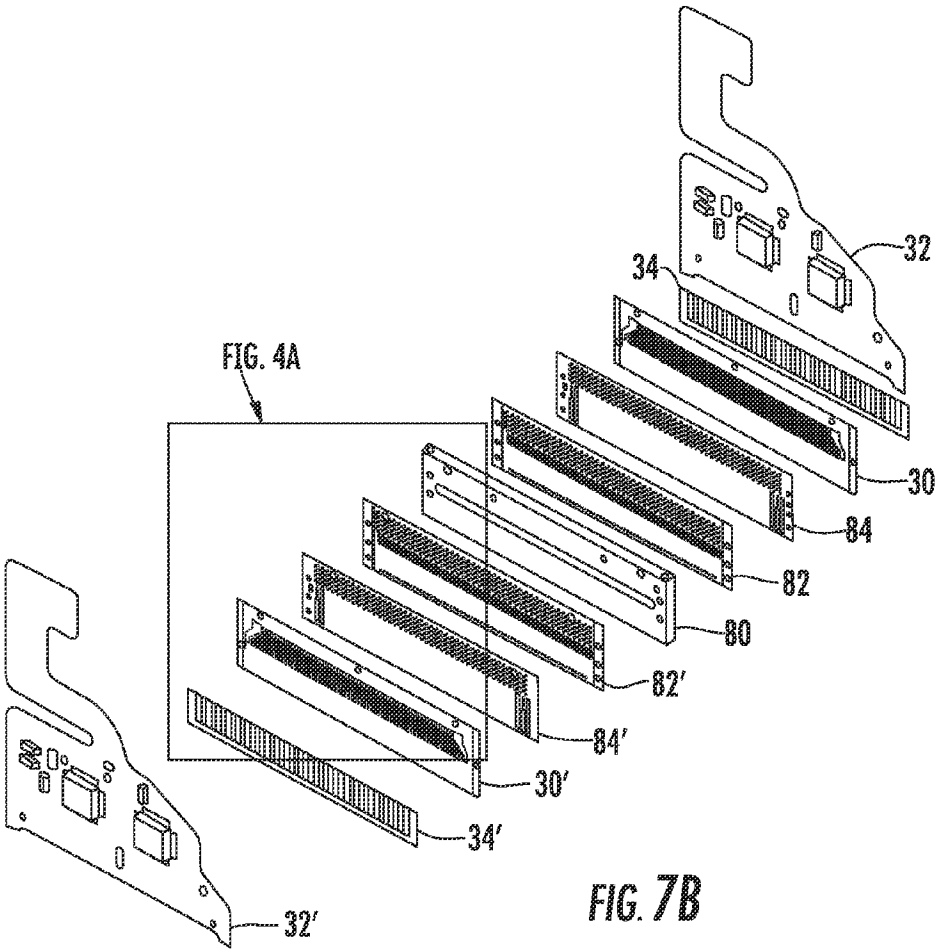
FIG. 7A is an exploded view of another embodiment of an ink jet module illustrated in FIG. 7B.
Figure 7A:
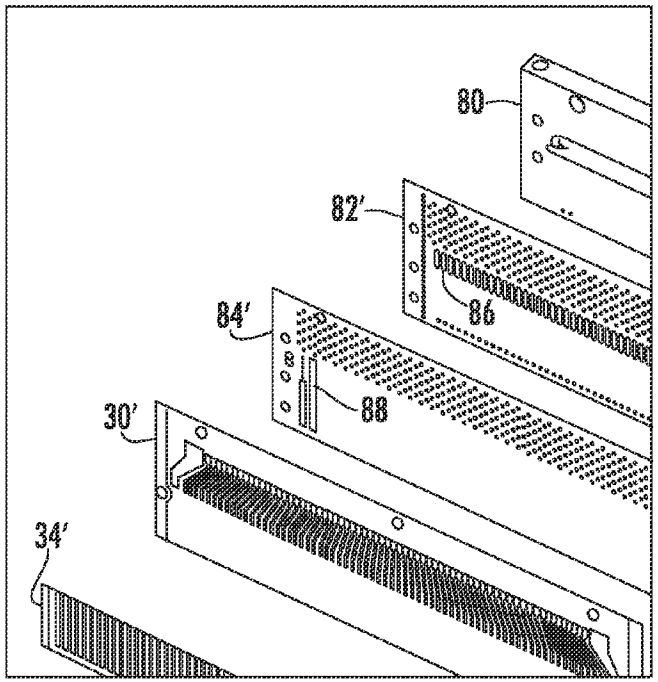

FIG. 7A is an exploded view of another embodiment of an ink jet module illustrated in FIG. 7B. In this embodiment, the jet body is comprised of multiple parts. The frame of the jet body 80 is sintered carbon and contains an ink fill passage. Attached to the jet body on each side are stiffening plates 82 and 82', which are thin metal plates designed to stiffen the assembly. Attached to the stiffening plates are cavity plates 84 and 84', which are thin metal plates into which pumping chambers have been chemically milled. Attached to the cavity plates are the flex prints 30 and 30', and to the flex prints are attached the piezoelectric elements 34 and 34'. All these elements are bonded together with epoxy. The flex prints that contain the drive circuitry 32 and 32', can be attached by a soldering process.

Figure 8:
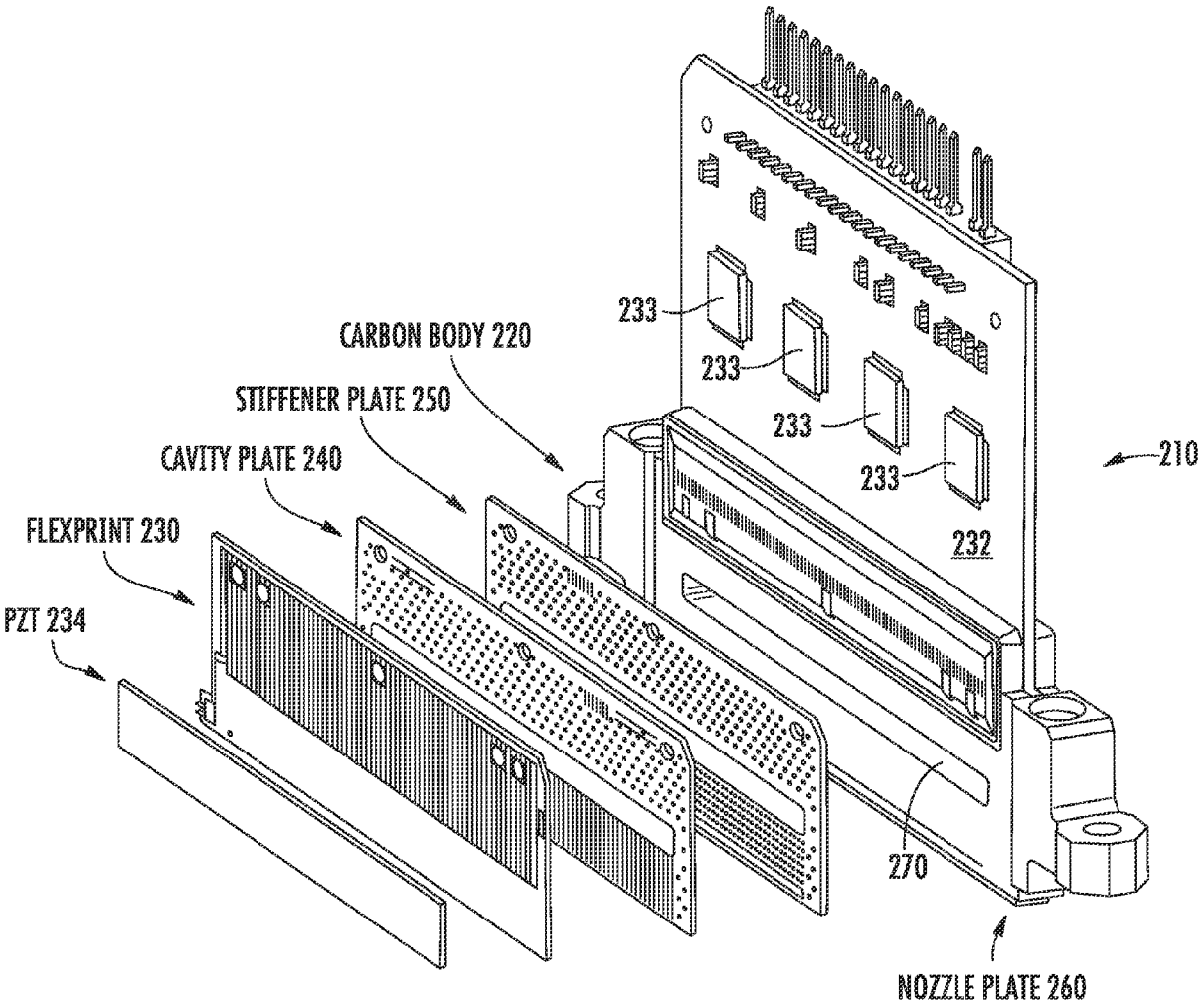
FIG. 8 is a shear mode piezoelectric ink jet print head in accordance with another embodiment.

FIG. 8 is a shear mode piezoelectric ink jet print head in accordance with another embodiment. The ink jet print head illustrated in FIG. 8 is similar to the print head illustrated in FIG. 4. However, the print head in FIG. 8 has a single ink jet module 210 in contrast to the dual ink jet modules 4 and 6 in FIG. 4. In some embodiments, the ink jet module 210 includes the following components: a carbon body 220, stiffener plate 250, cavity plate 240, flex print 230, PZT member 234, nozzle plate 260, ink fill passage 270, flex print 232, and drive electronic circuits 233. These components have similar functionality as those components described above in conjunction with FIGS. 4-7.

Figure 9:
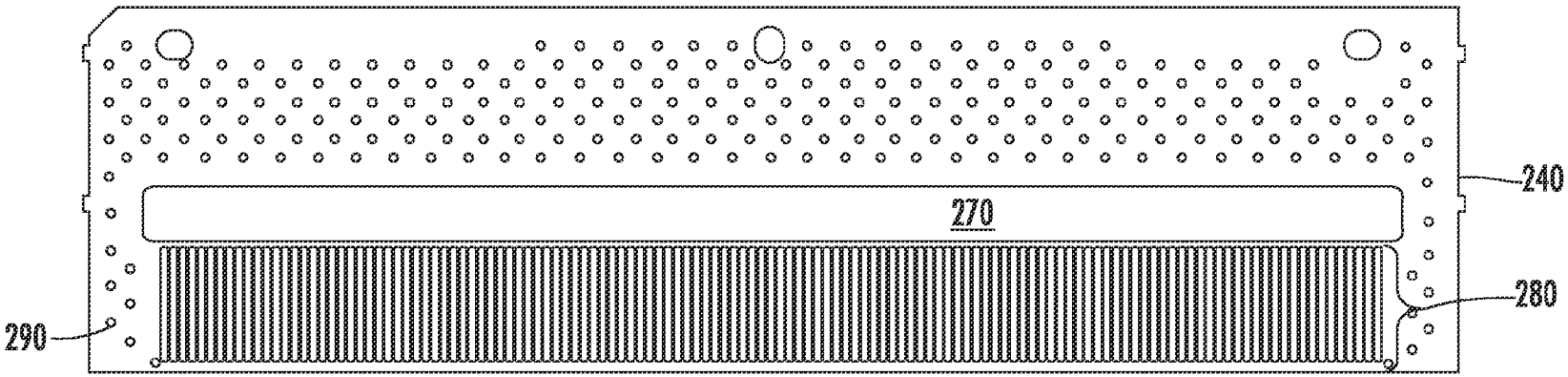
FIG. 9 is a perspective view of an ink jet module illustrating a cavity plate in accordance with one embodiment.

A cavity plate is illustrated in more detail in FIG. 9 in accordance with one embodiment. The cavity plate 240 includes holes 290, ink fill passage 270, and pumping chamber 280 that are distorted or actuated by the PZT 234. The ink jet module 210 which may be referred to as a drop ejection device includes a pumping chamber as illustrated in FIGS. 8 and 9. The PZT member 234 (e.g., actuator) is configured to vary the pressure of fluid in the pumping chambers in response to the drive pulses applied to the drive electronics 233. For one embodiment, the PZT member 234 ejects drops of a fluid from the pumping chambers. The drive electronics 233 are coupled to the PZT member 234. During operation of the ink jet module 210, the drive electronics 233 drive the PZT member 234 with a multi-pulse waveform having at least one drive pulse and at least one straightening pulse. The at least one drive pulse builds a drop of a fluid. A straightening pulse corrects a potential drop trajectory error of the drop. The drive electronics cause the actuator to eject the drop with a straight trajectory in response to the pulses of the multi-pulse waveform. In one embodiment, the multi-pulse waveform may include first and second drive pulses with the second drive pulse having a first peak voltage followed by the straightening pulse having a second peak voltage. The second peak voltage can be based on the first peak voltage.

Figure 10:
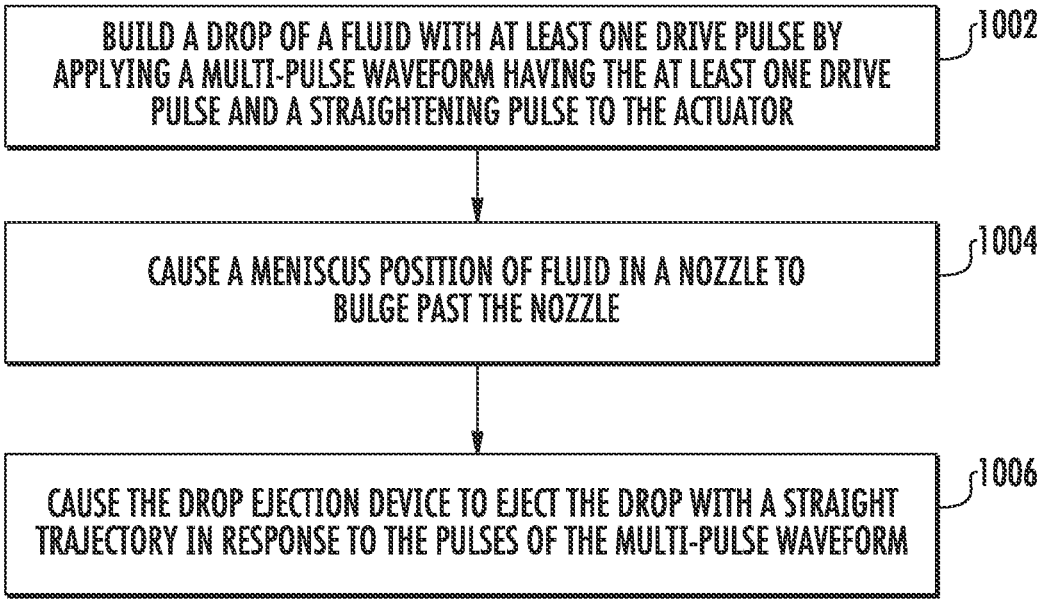
FIG. 10 illustrates a flow diagram of an embodiment for driving a drop ejection device with a multi-pulse waveform having a straightening pulse to eject a drop with a straight drop trajectory.

FIG. 10 illustrates a flow diagram of a process for driving a drop ejection device with a multi-pulse waveform to eject a drop having a straight trajectory in accordance with one embodiment. The process for driving a drop ejection device having an actuator includes building a drop of a fluid with at least one drive pulse by applying a multi-pulse waveform having the at least one drive pulse and a straightening pulse to the actuator at processing block 1002. Next, the process includes causing a meniscus position of fluid in the nozzle to bulge past the nozzle at processing block 1004. Next, the process includes causing the drop ejection device to eject the drop with a straight trajectory in response to the pulses of the multi-pulse waveform at processing block 1006. The straightening pulse is designed to eject the drop without a drop trajectory error. The straightening pulse is also designed to eject the drop without forming a sub-drop or satellite because a jet velocity response, which is characterized by the ejection drop velocity of the drop ejection device, is approximately zero for the straightening pulse. The straightening pulse causes the straightening of the drop formed by the at least one drive pulse in order to reduce a potential drop trajectory error.

In some embodiments, the nozzle is a non-circular shape. The at least one drive pulse is tuned at approximately a maximum drop velocity in a frequency response of the drop ejection device to build the drop and the straightening pulse is tuned at approximately a minimum drop velocity in a frequency response of the drop ejection device in order to eject the drop with a reduced drop trajectory error. The multi-pulse waveform includes a drive pulse having a first peak voltage followed by the straightening pulse having a second peak voltage with the second peak voltage being based on the first peak voltage. In an embodiment, the second peak voltage is less than the first peak voltage. Increasing the second peak voltage causes the meniscus position of fluid in the nozzle to further bulge past the nozzle.

In one embodiment, the drop ejection device ejects additional boluses of the fluid in response to the pulses of the multi-pulse waveform or in response to pulses of additional multi-pulse waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. The waveform data is stored in a table as a series of address, voltage, and flag bit samples and can be accessed with software. A waveform provides the data necessary to produce a single sized drop and various different sized drops.

As previously discussed, transient jet straightness occurs when a jet that is straight immediately after priming goes crooked after a period of jetting. These jets may or may not self-recover after a further period of jetting. A jet trajectory error arises from crooked jets. Print heads with non-circular nozzles (e.g., square nozzles with sharp or rounded edges) may be more susceptible to the trajectory error. This phenomenon can be affected by the meniscus position of the fluid. If the meniscus is positioned near the plane of the nozzle when the tail of a drop breaks off, the tail can attach to the side/corner of the nozzle and cause an error in the trajectory of the drop. If the meniscus is proud of the nozzle when the tail breaks off, or possibly retracted, the tail is centered on the bulging ink mass at the nozzle and the jet is straight.

In one embodiment, a straightening pulse is used to cause the meniscus to be proud of the nozzle with the straightening pulse being lower in amplitude than a driving pulse and subsequent to the driving pulse. In some jet designs and under certain conditions for meniscus pressure, viscosity, and ink sound speed, the meniscus position is bulging at tail break-off without an added pulse on the waveform.

Figure 11B:
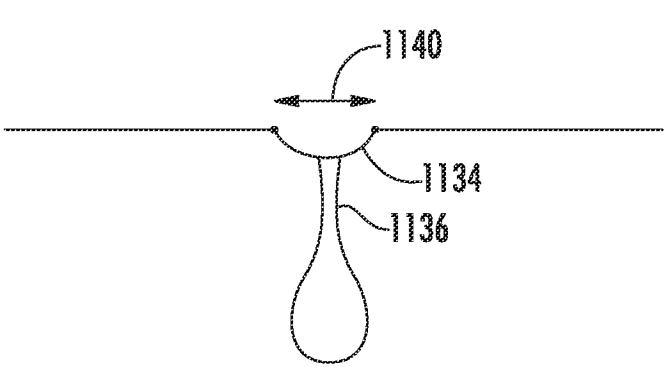
FIG. 11B illustrates a single drive pulse and a straightening pulse with a bulging meniscus and a tail centered with respect to the nozzle opening in accordance with one embodiment.
Figure 11B:
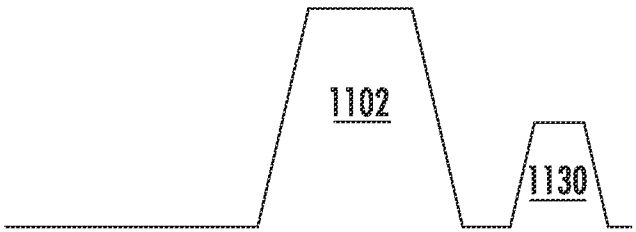
Figure 11A:
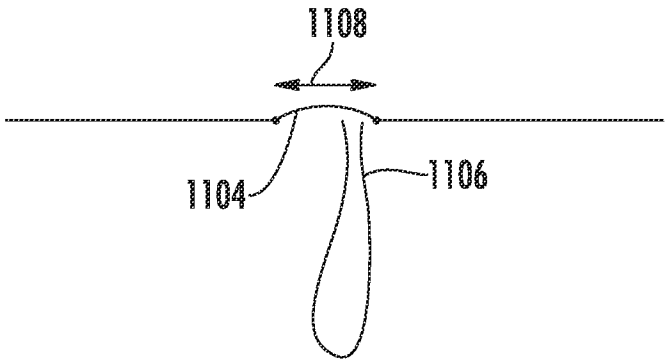
FIG. 11A illustrates a single drive pulse 1102 with a retracting meniscus 1104 and an off-centered tail with respect to a nozzle opening in accordance with a conventional approach.
Figure 11A:
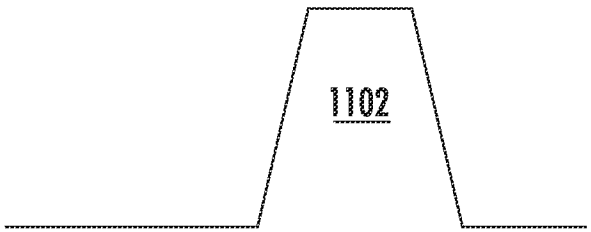

FIG. 11A illustrates a single drive pulse 1102 causing a retracting meniscus 1104 and the tail 1106 moving to one side of the nozzle opening 1108. FIG. 11B illustrates a single drive pulse 1120 and a straightening pulse 1130 that cause a bulging meniscus 1134 and the tail 1136 centered with respect to the nozzle opening 1140. Alternatively, the straightening pulse can be added to a sequence of drive pulses to eject the drop with a straight trajectory. It is desirable for the tail of the drop to be centered with respect to the nozzle opening to minimize the trajectory drop error. This will improve image quality and product quality. Temperature increases may change meniscus characteristics that enable more favorable symmetric fluid wetting of the jet nozzles. The straightening pulse additionally changes meniscus bounce to provide more favorable wetting.

Figure 12:
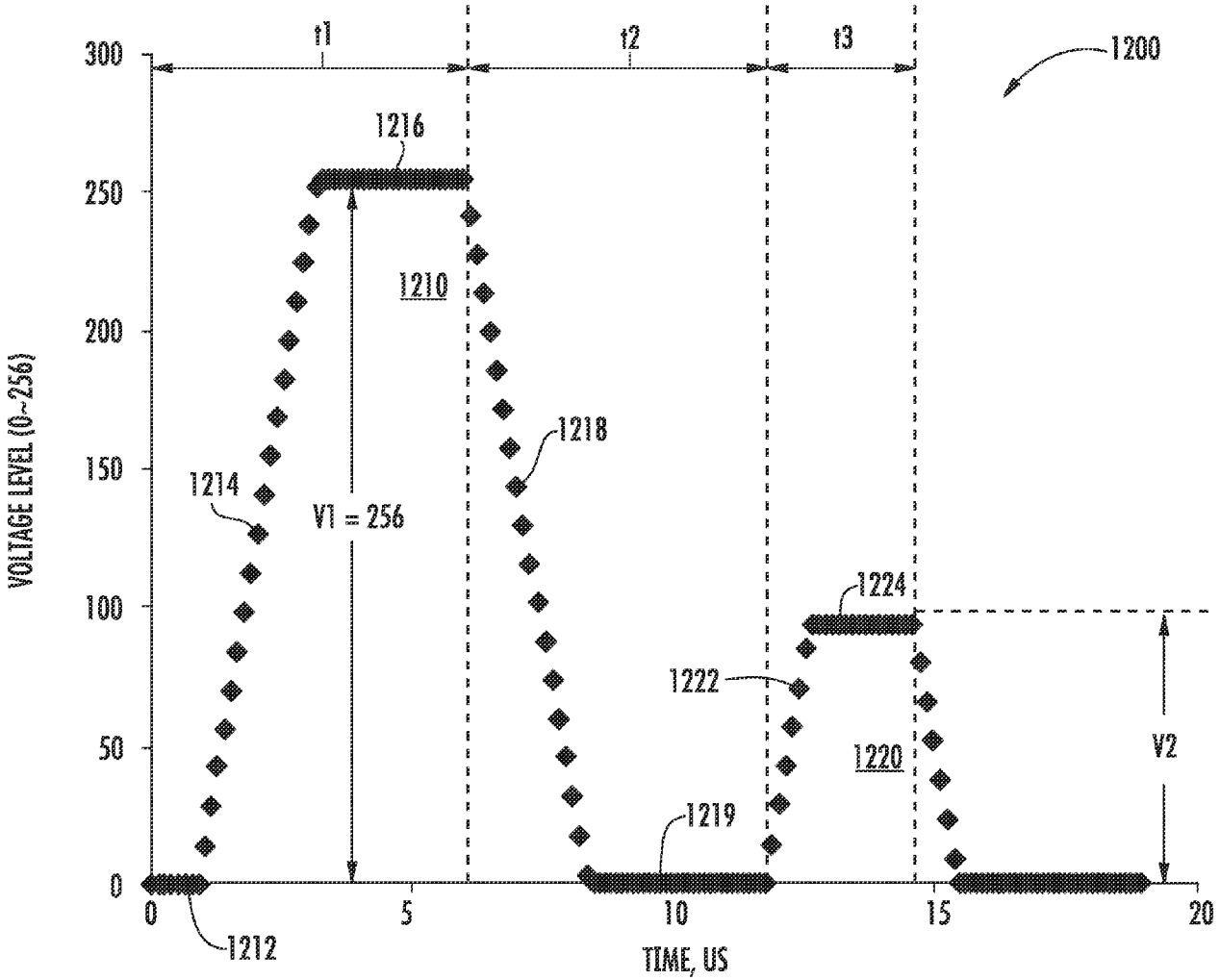
FIG. 12 illustrates a multi-pulse waveform with one drive pulse and one straightening pulse in accordance with one embodiment.

FIG. 12 illustrates a multi-pulse waveform with one drive pulse and one straightening pulse in accordance with one embodiment. During operation, each ink jet may jet a single drop in response to a multi-pulse waveform. An example of a multi-pulse waveform is shown in FIG. 12. In this example, multi-pulse waveform 1200 has two pulses. Each multi-pulse waveform would typically be separated from subsequent waveforms by a period corresponding to an integer multiple of the jetting period (i.e., the period corresponding to the jetting frequency). Each pulse can be characterized as having a "fill" ramp, which corresponds to when the volume of the pumping element increases, and a "fire" ramp (of opposite slope to the fill ramp), which corresponds to when the volume of the pumping element decreases. Typically, the expansion and contraction of the volume of the pumping element creates a pressure variation in the pumping chamber that tends to drive fluid out of the nozzle.

In certain embodiments, the multi-pulse waveform 1200 has drive pulse 1210 fired to cause the drop ejection device to eject the drop of the fluid. In one embodiment, the drive pulse 1210 has a voltage level between 0 and 256 which corresponds to a predefined range of voltages depending upon a particular drop ejection application. In one embodiment, the drive pulse 1210 has a peak voltage V1 of approximately 256 volts. The straightening pulse 1220 has a peak voltage V2 based upon the peak voltage of the drive pulse 1210.

In some embodiments, a peak voltage V2 of the straightening pulse 1220 is less than a peak voltage V1 of the drive pulse 1210. In an embodiment, V2 is 25% of V1. V2 depends on the ink viscosity. The lower the ink viscosity, the lower the value of V2 is needed. V2 needs to be sufficiently large to reduce the drop trajectory error and straighten the jets. A larger V2 increases the meniscus bulge at break-off of the drop.

A first time period t1 is associated with a first delay segment 1212, a fill segment 1214, and a second delay segment 1216 of the drive pulse 1210. A second time period t2 is associated with a fire segment of the drive pulse 1218 and a third delay segment 1219. A third time period t3 is associated with a fill segment 1222 and a fourth delay segment 1224 of the drive pulse 1220. It is desirable to minimize t2 for high frequency operation and still effectively reduce or eliminate drop trajectory error with the pulse 1220. In one embodiment, t2 is at least 63% of t1. In another embodiment, t2 is approximately 80% of t1 and t3 is approximately 55% of t1. The third time period t3 needs to be minimized for high frequency operation and also to not generate another drop or sub-drop. The second and third time periods can be longer for lower frequency operations.

The drive pulse occurs prior to the one straightening pulse in the multi-pulse waveform 1200. In other embodiments, additional drive pulses occur prior to one or more straightening pulses. The drop may have a native drop size in relation to the drop ejection device. In one embodiment, the waveform 1200 produces a 25-35 ng drop from an ejector that nominally produces a 25-35 ng drop for a particular printhead and ink type. In another embodiment, the waveform 1200 produces a 7-10 ng drop from an ejector that nominally produces a 7-10 ng drop for a particular printhead and ink type.

In certain embodiments, other waveform configurations may be considered. In an embodiment, more than two drive pulses may be used to produce the drop. In some applications, the one or more drive pulses may be negative or the straightening pulse may be negative.

Figure 13:
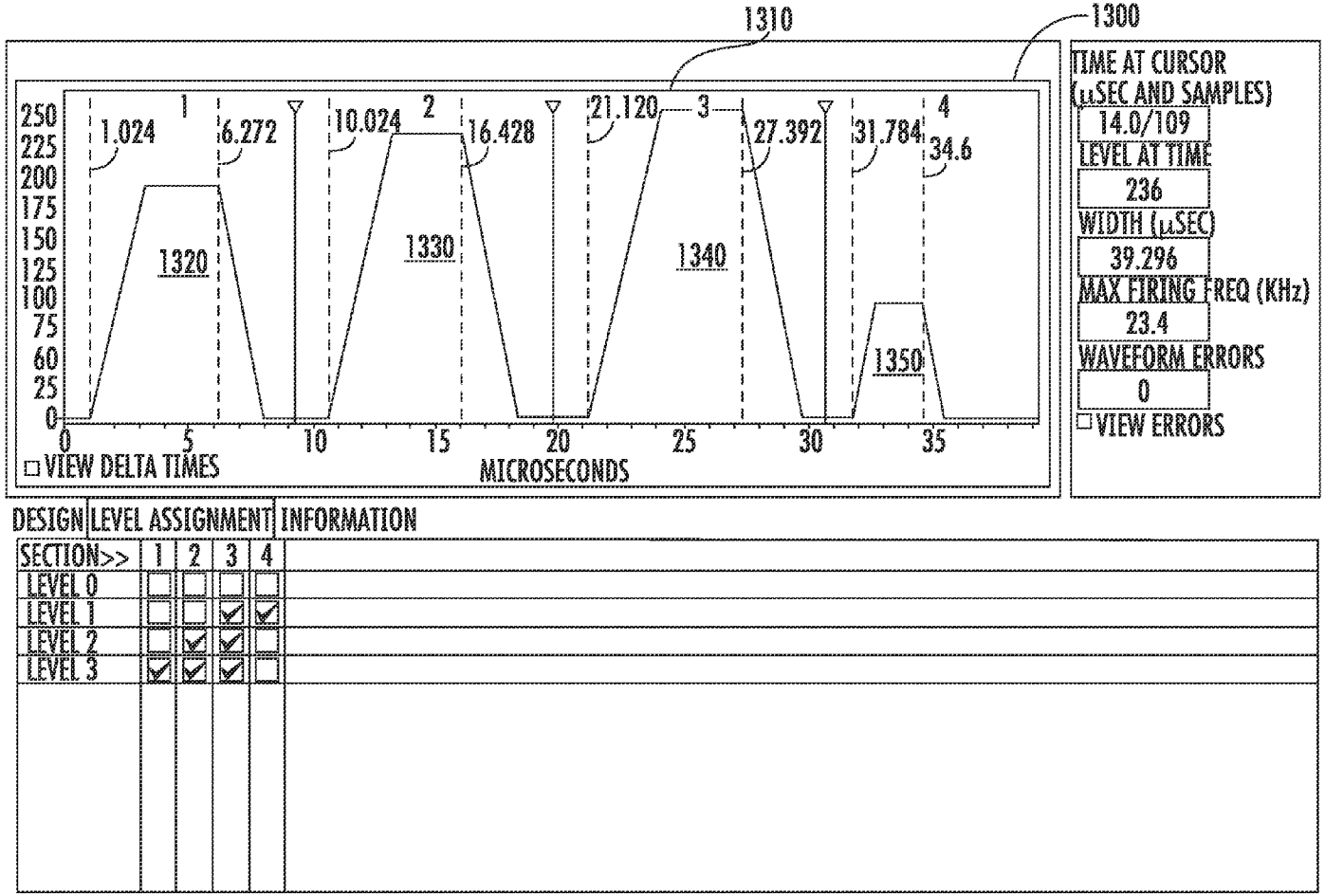
FIG. 13 illustrates a multi-pulse waveform in accordance with another embodiment.

FIG. 13 illustrates a multi-pulse waveform in accordance with one embodiment. Sections 1-4 correspond to pulses 1320, 1330, 1340, and 1350, respectively. Various drop sizes can be produced with these pulses. For example, a native small drop size can be produced with sections 3 and 4, which correspond to pulses 1340 and 1350. A medium drop size can be produced with sections 2 and 3, which correspond to pulses 1330 and 1340. A large drop size can be produced with sections 1 and 2, which correspond to pulses 1320 and 1330. Pulse 1350 or another straightening pulse can be added to any of the driving pulses if necessary to eject drops with straight trajectories.

In one embodiment, the one or more drive pulses are tuned at approximately a maximum drop velocity in the frequency response of the drop ejection device. This is necessary to keep the overall waveform time short, which is a requirement for high frequency operation.

A straightening pulse is tuned at approximately a minimum drop velocity in a frequency response of the drop ejection device. At this frequency, the jet velocity response, which is characterized by the drop velocity, is approximately zero. For this reason, the straightening pulse does not tend to eject a sub-drop, or satellite drop.

Figure 14:
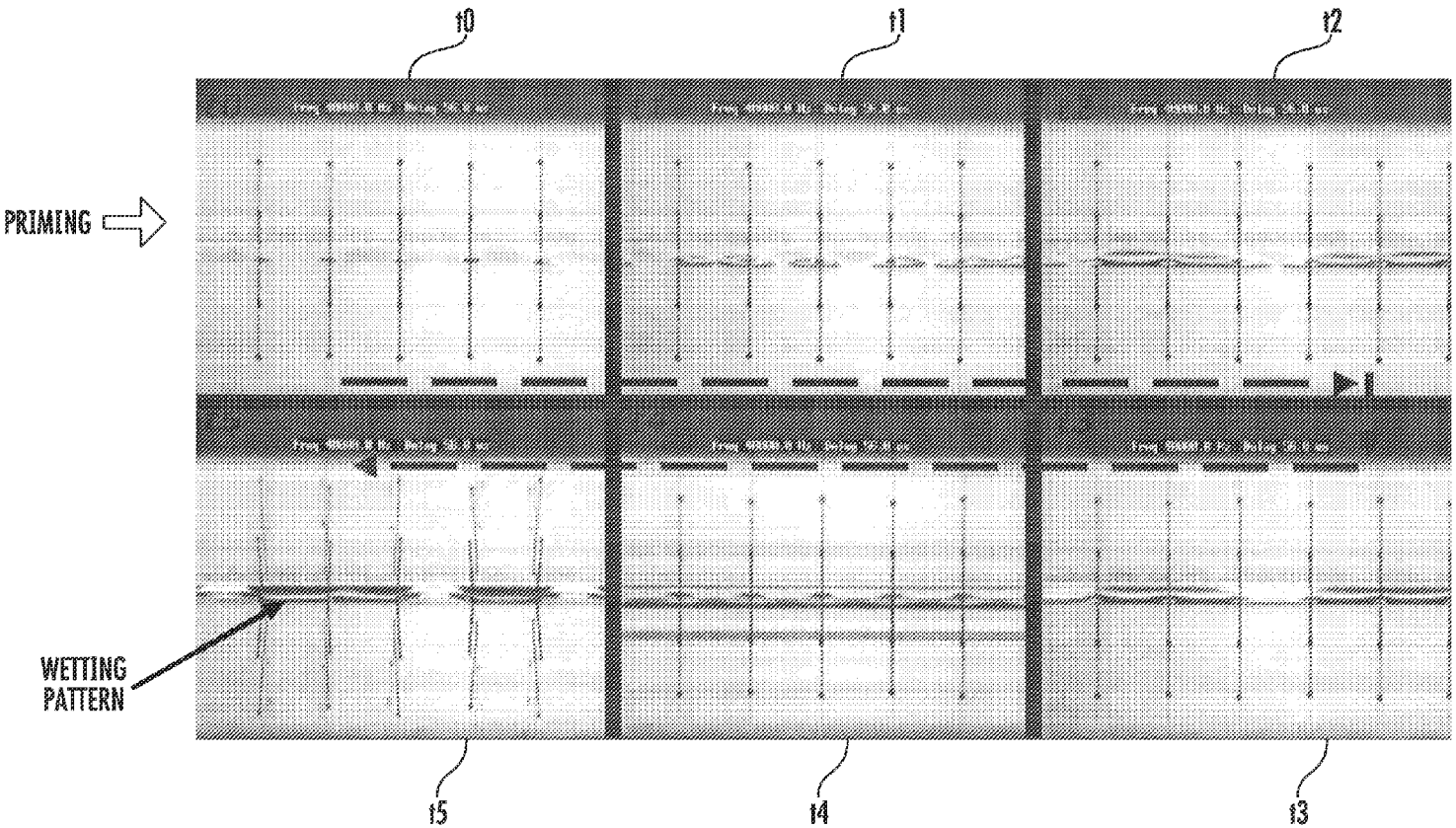
FIG. 14 illustrates the formation of asymmetric wetting around a nozzle in accordance with one embodiment.

FIG. 14 illustrates the formation of asymmetric wetting around a nozzle in accordance with one embodiment. Asymmetric wetting around the nozzle over a period of time is a potential cause of transient jet straightness. For example, the images associated with time periods t0-t5 illustrate a sequence of time with asymmetric wetting issues. The time interval is 1 to 3 seconds between consecutive images. A straightening pulse subsequent to a drive pulse reduces the asymmetric wetting to reduce transient jet straightness issues.

Figures 15, 16:
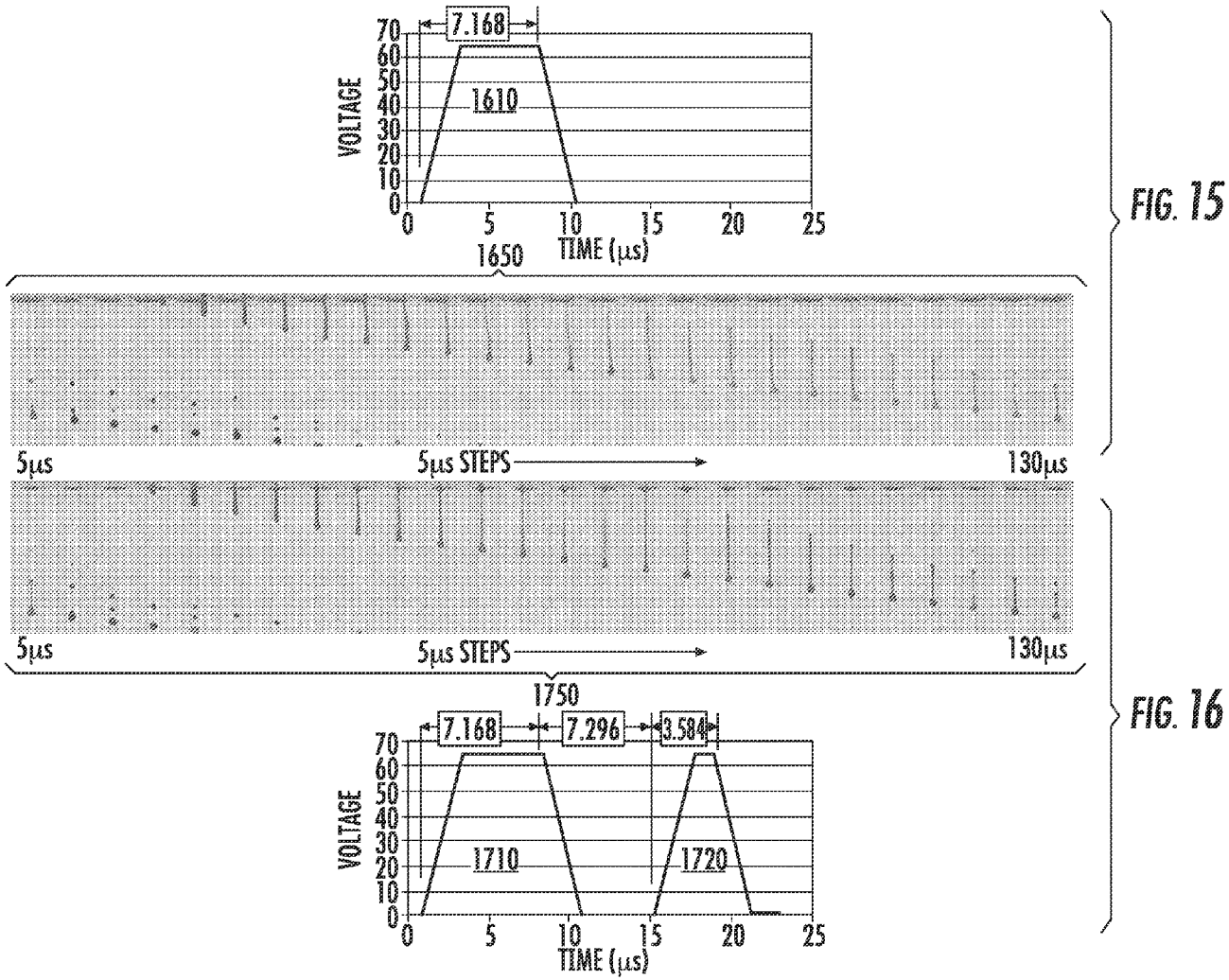
FIG. 15 illustrates a single pulse waveform and corresponding drop ejection in accordance with a conventional approach.
FIG. 16 illustrates a multi-pulse waveform and corresponding drop ejection in accordance with one embodiment.

FIG. 15 illustrates a single pulse waveform and corresponding drop ejection in accordance with a conventional approach. A drive pulse 1610 has a pulse width of 7.168 microseconds, peak voltage of approximately 60 volts, and 8.2 kHz frequency. A drop is ejecting from a nozzle opening which is shown with 5 microsecond time slices in time slice 1650. The drop at break-off is off-centered with respect to the nozzle opening and has a drop trajectory error. A meniscus position at break-off is retracting in the nozzle opening.

FIG. 16 illustrates a multi-pulse waveform and corresponding drop ejection in accordance with one embodiment. A drive pulse 1710 has a pulse width of 7.168 microseconds, peak voltage of approximately 60 volts, and 8.2 kHz frequency. A subsequent straightening pulse 1720 has a similar peak voltage and a pulse width one half of the pulse 1720. A drop is ejecting from a nozzle opening which is shown with 5 microsecond time slices in time slice 1750. The drop at break-off is centered with respect to the nozzle opening and has a reduced drop trajectory error. A meniscus position at break-off is bulging past the nozzle opening.

Figure 17:
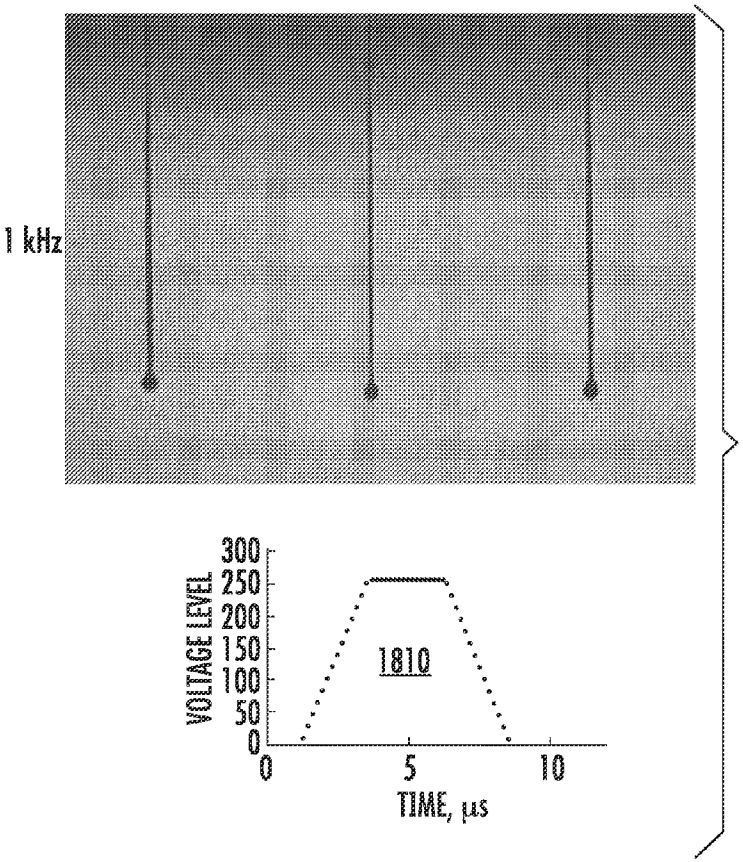
FIG. 17 illustrates a single pulse waveform and corresponding drop ejection in accordance with another conventional approach.

FIG. 17 illustrates a single pulse waveform and corresponding drop ejection in accordance with another conventional approach. A drive pulse 1810 has a peak voltage of approximately 250 volts and 1 kHz frequency. The drop at break-off is off-centered with respect to the nozzle opening and a meniscus position at break-off is retracting in the nozzle opening.

Figure 18:
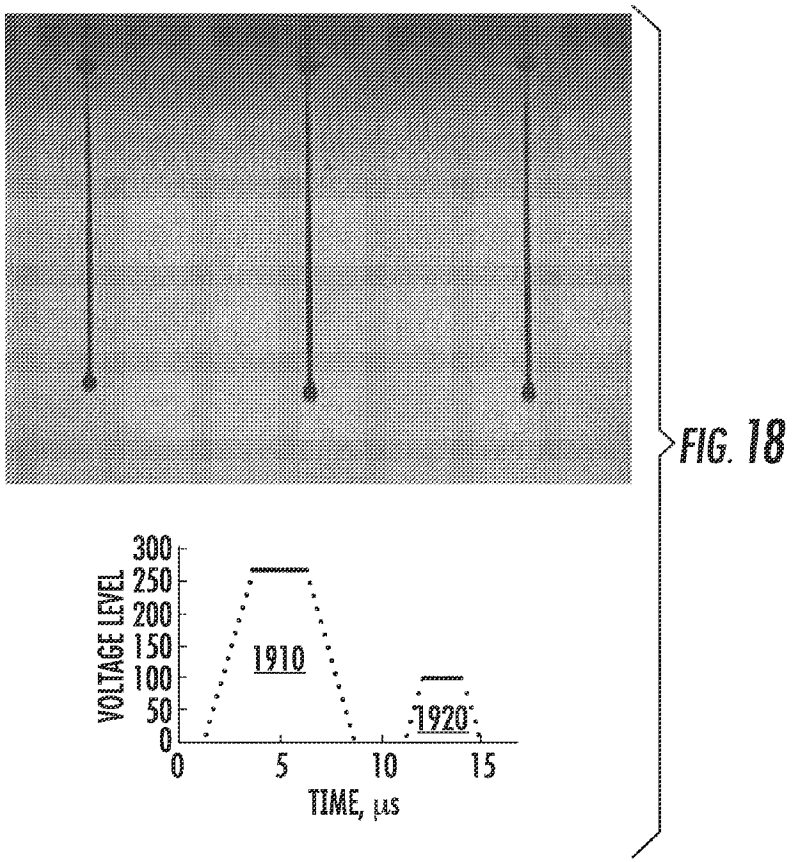
FIG. 18 illustrates a multi-pulse waveform and corresponding drop ejection in accordance with one embodiment.

FIG. 18 illustrates a multi-pulse waveform and corresponding drop ejection in accordance with one embodiment. A drive pulse 1910 has a peak voltage of approximately 250 volts and 1 kHz frequency. A subsequent straightening pulse 1920 has a substantially lower peak voltage and a shorter pulse width. The drop at break-off is centered with respect to the nozzle opening and has a reduced drop trajectory error. A meniscus position at break-off is bulging past the nozzle opening.

Figure 19:
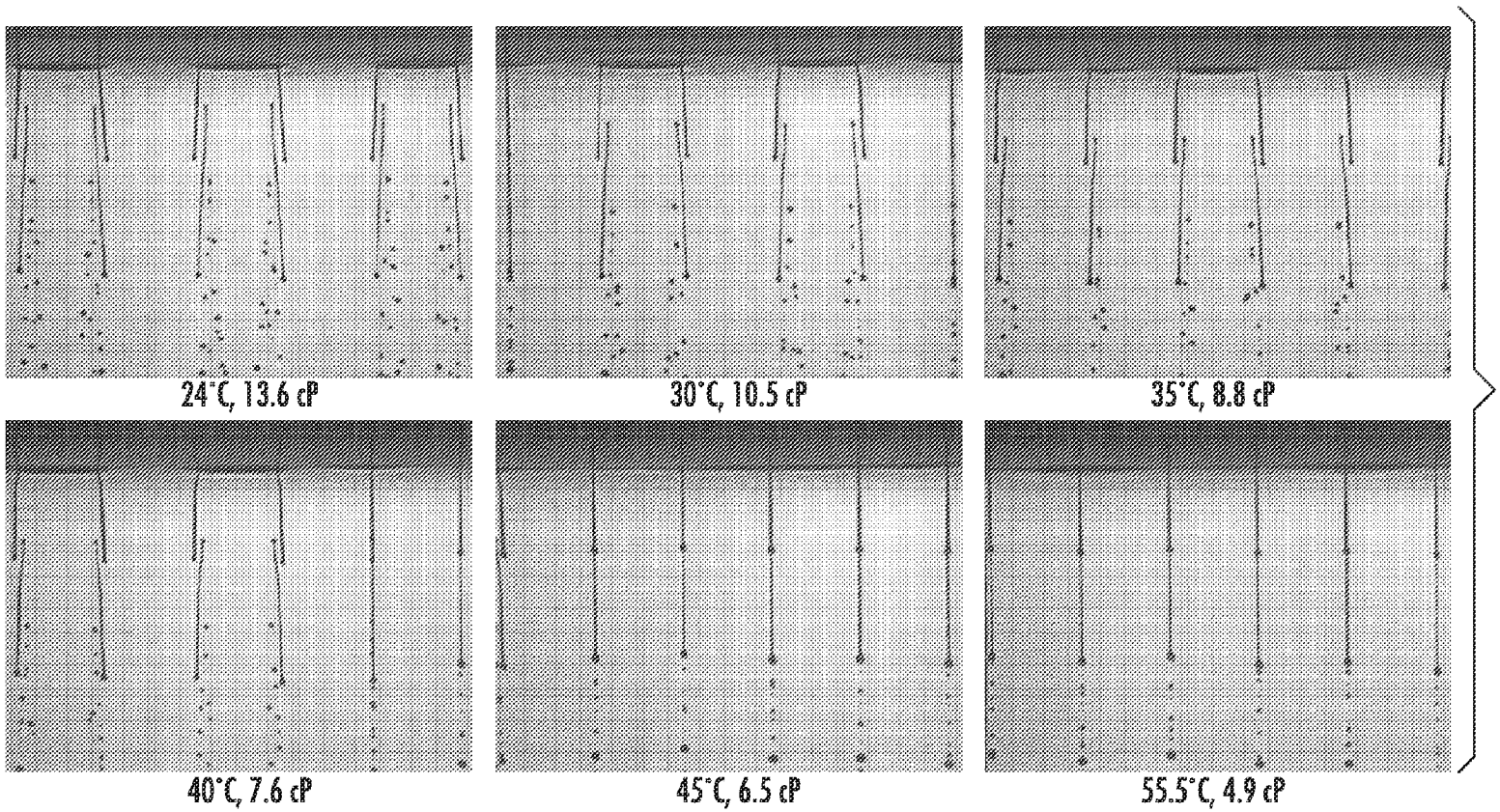
FIG. 19 illustrates drop ejection for different temperatures and ink viscosities levels in accordance with some embodiments.

FIG. 19 illustrates drop ejection for different temperatures and ink viscosities levels in accordance with some embodiments. An increase in temperature decreases ink viscosity which leads to more favorable meniscus characteristics and symmetric wetting. The drop ejection images associated with higher temperatures (e.g., 45 degrees C., 55.5 degrees C.) and lower ink viscosities (e.g., 6.5 cP, 4.9 cP) illustrate straight drop ejection.

However, a lower ink viscosity may lead to other issues such as UV ink instability, solvent drying rate, and decreased meniscus damping which causes the gulping of air. A straightening pulse can be used with one or more drive pulses to eject a drop with a straight trajectory with respect to a target. The straightening pulse can be used with different temperature ranges and ink viscosities to avoid the issues associated with lower ink viscosity. This will improve image quality and product quality for printing applications.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method for driving a drop ejection device having an actuator and a nozzle, comprising:

building a drop of a fluid with at least one drive pulse by applying a multi-pulse waveform to the actuator, the waveform having the at least one drive pulse and a straightening pulse following the at least one drive pulse; and causing the drop ejection device to eject the drop with a straightened trajectory in response to the pulses of the multi-pulse waveform, wherein the straightening pulse is designed to cause the straightening of the drop with respect to the nozzle, wherein the straightening pulse has a pulse width that is less than a pulse width of the at least one drive pulse.

2. The method defined in claim 1 wherein the nozzle comprises a non-circular shape.

3. The method of claim 1, wherein the straightening pulse is tuned at approximately a minimum drop velocity in a frequency response of the drop ejection device.

4. The method of claim 3, further comprising causing a meniscus position of fluid in the nozzle to bulge past the nozzle in response to the straightening pulse.

5. The method of claim 4, wherein the multi-pulse waveform comprises a drive pulse having a first peak voltage followed by the straightening pulse having a second peak voltage with the second peak voltage being based on the first peak voltage.

6. The method of claim 5, wherein the second peak voltage is less than the first peak voltage.

7. The method of claim 5, wherein increasing the second peak voltage causes the meniscus position of fluid in the nozzle to further bulge past the nozzle.

8. A method for driving a drop ejection device having an actuator and a nozzle, comprising:

building a drop of a fluid with at least one drive pulse by applying a multi-pulse waveform to the actuator, the waveform having the at least one drive pulse and a straightening pulse following the at least one drive pulse; and causing the drop ejection device to eject the drop with a straightened trajectory in response to the pulses of the multi-pulse waveform, wherein a first time period is associated with a first delay segment, a fill segment, and a second delay segment of the drive pulse and a second time period is associated with a fire segment of the drive pulse and a third delay segment with the second time period being at least 63% of the first time period.

9. The method of claim 8, wherein the second time period is approximately 80% of the first time period.

10. An apparatus, comprising:

a pumping chamber;

an actuator coupled to the pumping chamber, the actuator to eject a drop of a fluid from the pumping chamber; and drive electronics coupled to the actuator, wherein during operation the drive electronics drive the actuator with a multi-pulse waveform having at least one drive pulse to build a drop of a fluid and a straightening pulse to cause the actuator to eject the drop forming at a nozzle with a straightened trajectory, wherein the straightening pulse is designed to cause the straightening of the drop with respect to the nozzle, wherein the straightening pulse has a pulse width that is less than a pulse width of the at least one drive pulse.

11. The apparatus of claim 10 wherein the nozzle comprises a non-circular shape.

12. The apparatus of claim 10, wherein the straightening pulse is tuned at approximately a minimum drop velocity in a frequency response of the apparatus.

13. The apparatus of claim 10, wherein the drive electronics to cause a meniscus position of fluid in the nozzle to bulge past the nozzle in response to the straightening pulse.

14. The apparatus of claim 10, wherein the multi-pulse waveform comprises a drive pulse having a first peak voltage followed by the straightening pulse having a second peak voltage with the second peak voltage being based on the first peak voltage.

15. The apparatus of claim 14, wherein the second peak voltage is less than the first peak voltage.

16. An apparatus, comprising:

a pumping chamber;

an actuator coupled to the pumping chamber, the actuator to eject a drop of a fluid from the pumping chamber; and drive electronics coupled to the actuator, wherein during operation the drive electronics drive the actuator with a multi-pulse waveform having at least one drive pulse to build a drop of a fluid and a straightening pulse to cause the actuator to eject the drop forming at a nozzle with a straightened trajectory, wherein a first time period is associated with a first delay segment, a fill segment, and a second delay segment of the drive pulse and a second time period is associated with a fire segment of the drive pulse and a third delay segment with the second time period being at least 63% of the first time period.

17. A printhead, comprising:

an ink jet module that comprises, a pumping chamber;

an actuator coupled to the pumping chamber, the actuator to eject a drop of a fluid from the pumping chamber; and drive electronics coupled to the actuator, wherein during operation the drive electronics drive the actuator with a multi-pulse waveform having at least one drive pulse to build a drop of a fluid and a straightening pulse to cause the actuator to eject the drop forming at a nozzle with a straightened trajectory, wherein the straightening pulse is designed to cause the straightening of the drop with respect to the nozzle, wherein the straightening pulse has a pulse width that is less than a pulse width of the at least one drive pulse.

18. The printhead of claim 17, wherein the straightening pulse is tuned at approximately a minimum drop velocity in a frequency response of the printhead.

19. The printhead of claim 17, wherein the multi-pulse waveform comprises first and second drive pulses with the first drive pulse having a first peak voltage followed by the straightening pulse having a second peak voltage with the second peak voltage being based on the first peak voltage.

20. The printhead of claim 17, wherein the ink jet module further comprises: a carbon body, a stiffener plate, a cavity plate, a first flexprint, a nozzle plate, an ink fill passage, and a second flexprint.

* * * * *